US006715899B1

(12) United States Patent
Wu

(10) Patent No.: US 6,715,899 B1
(45) Date of Patent: Apr. 6, 2004

(54) EASILY ASSEMBLED AND DETACHED WALL LAMP MOUNTING DEVICE

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/244,831

(22) Filed: Sep. 17, 2002

(51) Int. Cl.[7] ..... H01R 33/06; H01R 13/73; H01R 33/00

(52) U.S. Cl. ..... 362/226; 362/147; 362/432; 439/551; 439/699.2

(58) Field of Search ..... 362/226, 147, 362/414, 432, 457; 439/551, 699.2

(56) References Cited

U.S. PATENT DOCUMENTS 3,611,360 A * 10/1971 Bailey ..... 340/815.51
5,353,209 A * 10/1994 Foottit ..... 362/226
6,626,707 B2 * 9/2003 Henrici et al. ..... 439/699.2
2003/0139092 A1 * 7/2003 Wu ..... 439/551

* cited by examiner

*Primary Examiner*—Alan Cariaso
*Assistant Examiner*—James W Cranson, Jr.

(57) ABSTRACT

An easily assembled and detached wall lamp mounting device comprising a retaining seat, and a locking seat mounted on the retaining seat at one end; and another end of the locking seat being suspended with a wall lamp. The retaining seat is formed by a supporting tube; a receptacle; and a nut stud. The lamp tube has a plug at a position coupled to the retaining seat; and the plug is connected with an electric wire therein. The lamp tube is engaged with a positioning nut. After the plug is inserted into the receptacle of the retaining seat, the plug is tightly screwed into the nut stud for positioning the lamp tube to the retaining seat. In packaging, transferring or storage the lamp seat, the locking seat and the lamp rod are pulled out from the retaining seat in advance for reducing the volume for storage and transfer.

4 Claims, 4 Drawing Sheets

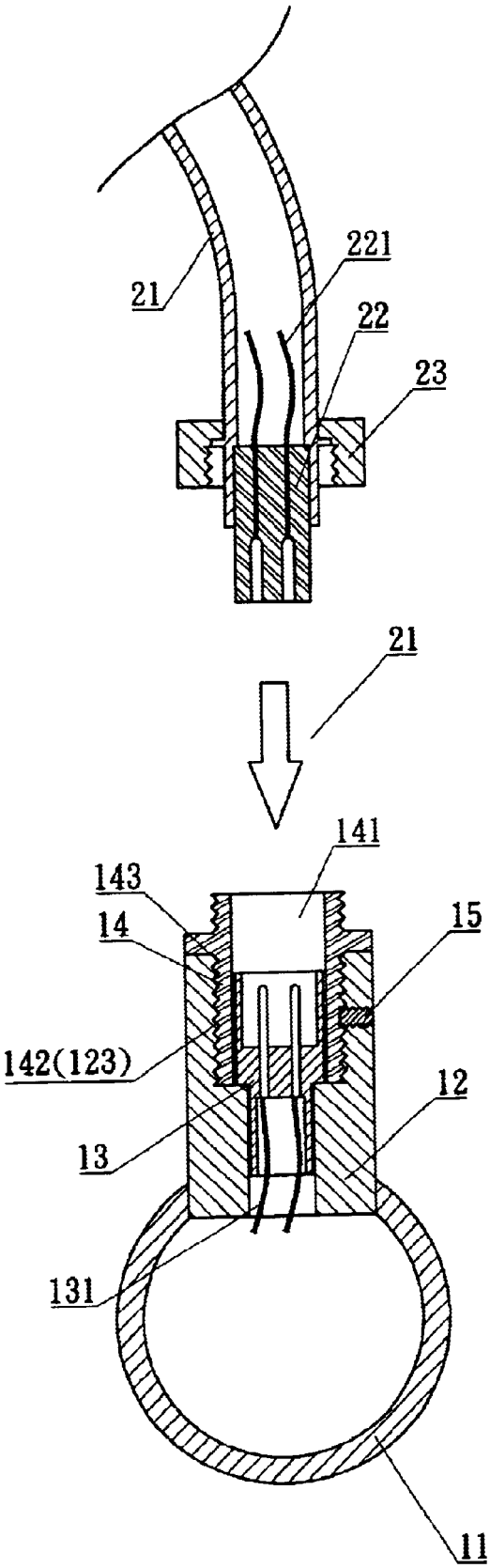
Fig. 3-A

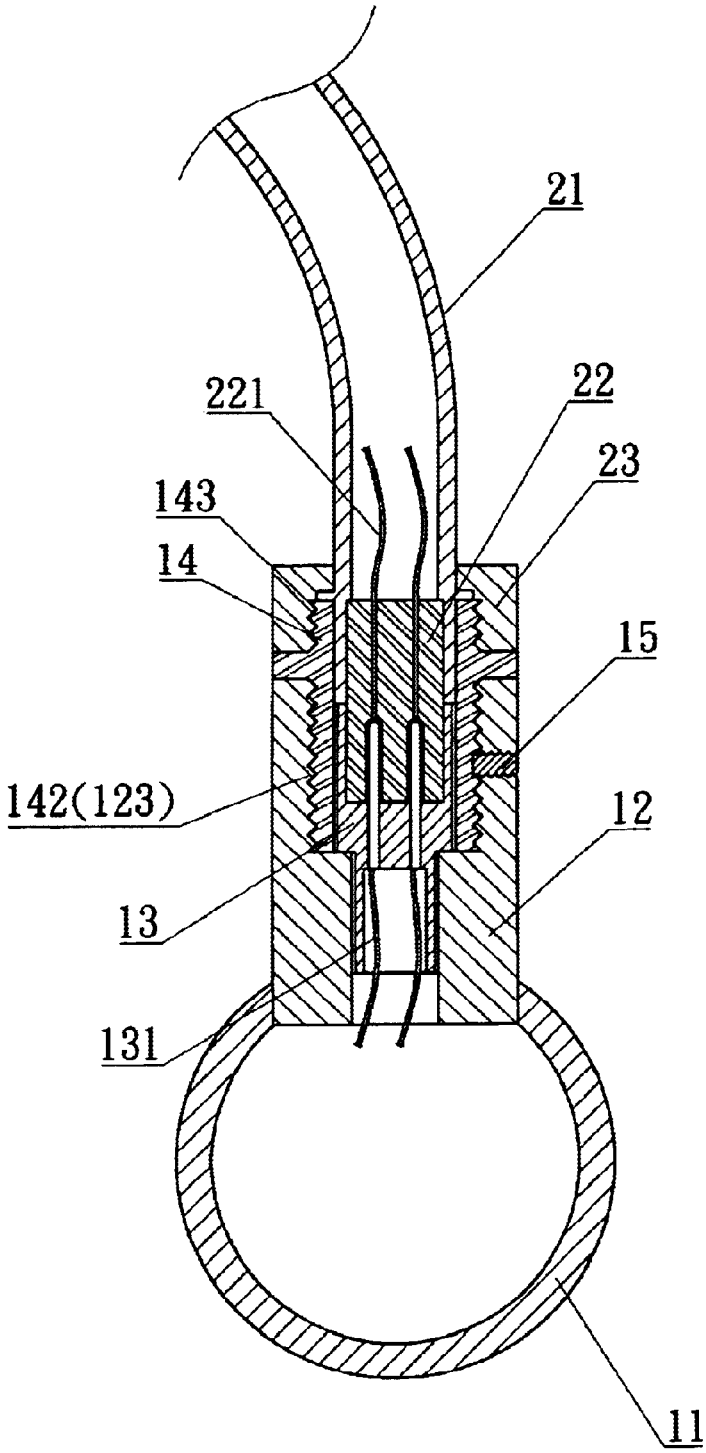
Fig. 3-B

EASILY ASSEMBLED AND DETACHED WALL LAMP MOUNTING DEVICE

FIELD OF THE INVENTION

The present invention relates to wall lamp assembly structure, and particularly to a easily assembled and detached wall lamp mounting device, wherein in packaging, transferring or storage the lamp seat, the locking seat and the lamp rod are pulled out from the retaining seat in advance for reducing the volume for storage and transfer.

BACKGROUND OF THE INVENTION

Prior wire connection devices of lamps, such as wall lamps, stand type lamps, and ceiling lamps, use studs and nuts to lock the components. In assembly, not only the user is easy to be harmed, but also other locking tools (such as spanners, openers, etc.) are necessary. Moreover, in assembly, electric wires are easy to expose out and some dangers are induced. Thereby, the prior art is not suitable to be assembled by the user himself (or herself). In general, since in the prior art design, the wire is possibly exposed out if the assembly work is performed by the user, the manufacturer assembles the device in advance, namely, the wire box is assembled with inserting rods in the manufacturing process. However, this will induce that a large space is required for transferring and storing and thus cost is increased.

SUMMARY OF THE INVENTION

Accordingly, the primary object of the present invention is to provide a easily assembled and detached wall lamp mounting device, wherein in packaging, transferring or storage the lamp seat, the locking seat and the lamp rod are pulled out from the retaining seat in advance for reducing the volume for storage and transfer.

To achieve above object, the present invention provide an easily assembled and detached wall lamp mounting device comprising a retaining seat, and a locking seat mounted on the retaining seat at one end; and another end of the locking seat being suspended with a wall lamp. The retaining seat is formed by a supporting tube firmly secured to a wall and a surface of which has at least one through hole and locking sleeve welded within the through hole of the supporting tube; a receptacle installed within the locking sleeve and having an electric wire therewithin; a nut stud locked to the locking sleeve and exactly resisting against an upper side of the receptacle. The locking seat is formed by a lamp tube extended from a top of the wall lamp and a plug in the lamp tube. The lamp tube has a plug at a position coupling to the retaining seat; and the plug is connected with an electric wire therein. The lamp tube is engaged with a positioning nut; after the plug is inserted into the receptacle of the retaining seat; the plug is tightly screwed into the top screwed section of the nut stud for positioning the lamp tube to the retaining seat.

The various objects and advantages of the present invention will be more readily understood from the following detailed description when read in conjunction with the appended drawing.

BRIEF DESCRIPTION OF THE DRAWINGS

FIG. 3A is a plane cross sectional view of the present invention before assembly.

FIG. 3B is a plane cross sectional view of the present invention after assembly.

DETAILED DESCRIPTION OF THE PREFERRED EMBODIMENTS

Figure 1:
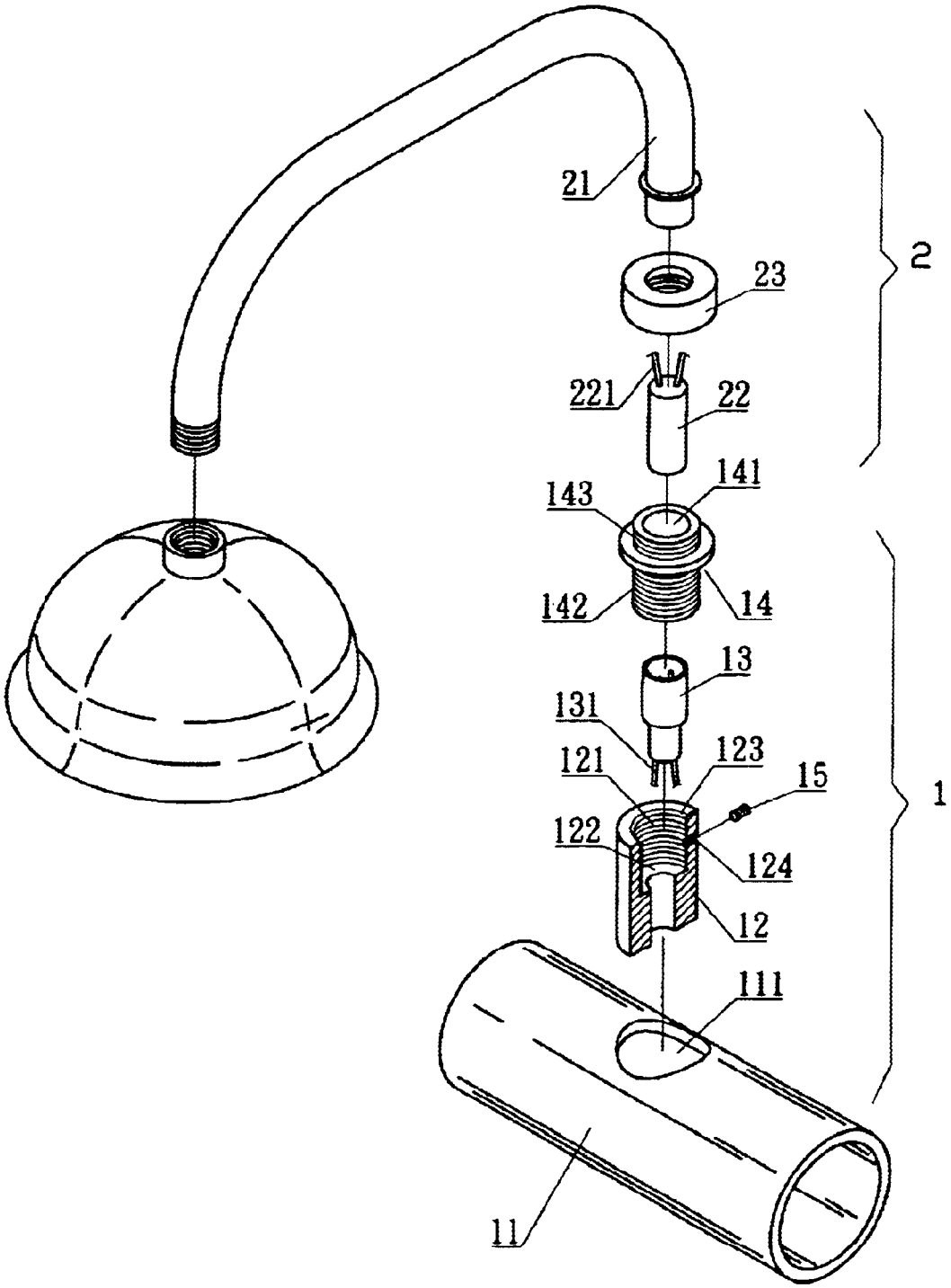
FIG. 1 is an exploded perspective view of the present invention.
Figure 2:
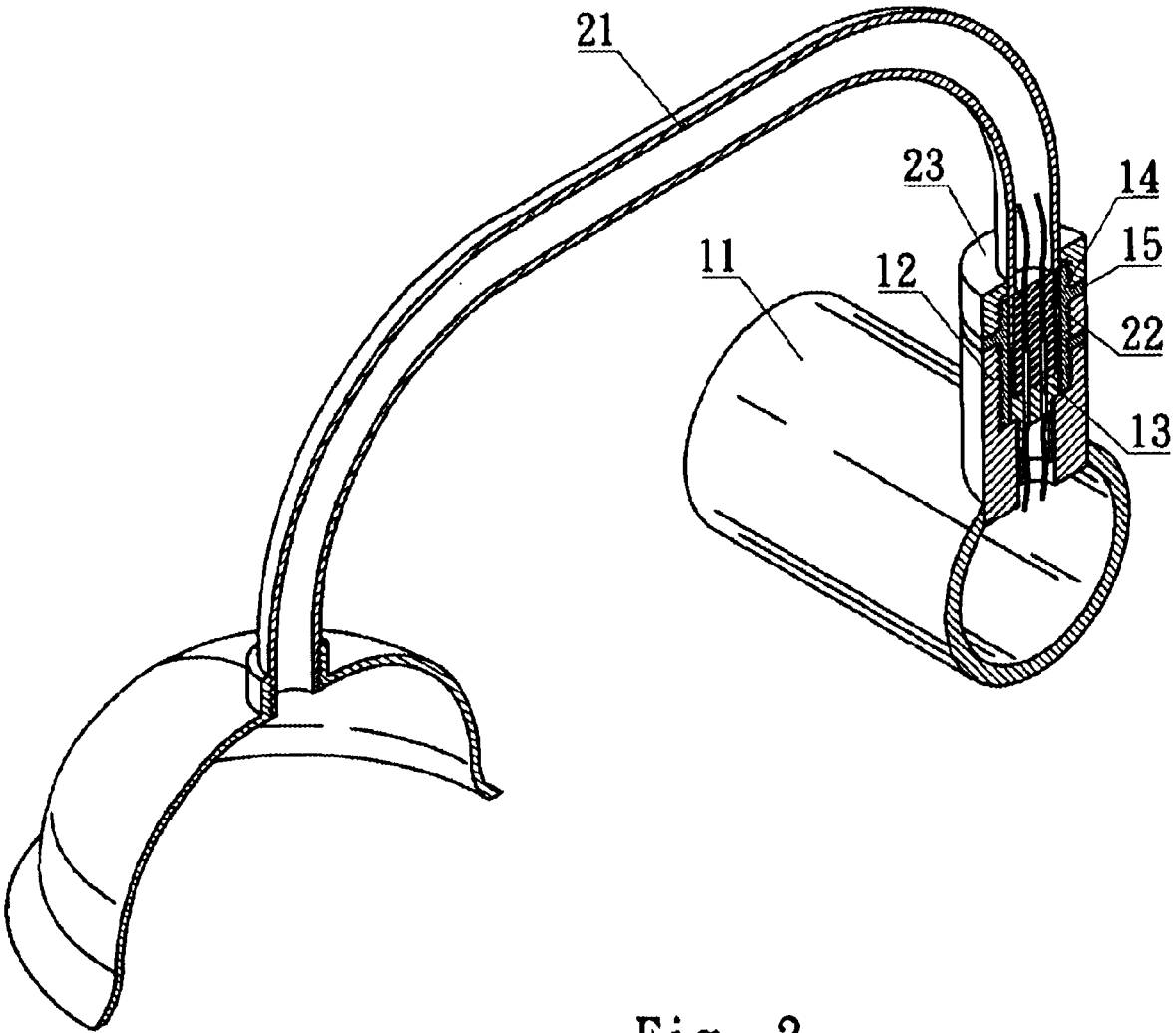
FIG. 2 is an assembled perspective view of the present invention.

Referring to FIGS. 1 and 2, the structure of the present invention is clearly shown. The present invention includes a retaining seat 1, and a locking seat 2 mounted on the retaining seat 1 at one end. Another end of the locking seat 2 is suspended with a wall lamp.

The retaining seat 1 is formed by a supporting tube 11 firmly secured to a wall and a surface of which has at least one through hole 111, a locking sleeve 12 welded within the through hole 111 of the supporting tube 11; a receptacle 13 installed within the locking sleeve 12 and having an electric wire 131 therewithin, and a nut stud 14 locked to the locking sleeve 12 and exactly pressing against an upper side of the receptacle 13. The through hole 111 of the supporting tube 11 can be engaged with a plurality of wall lamp.

The inner side of the locking sleeve 12 is installed with a stepped via hole 121. The receptacle 13 can be inserted into the via hole 121 and exactly resists against the stepped edge 122. The circular surface of the via hole 121 is formed with an inner threaded hole 123 for locking the nut stud 14. A confining hole 124 is formed by protruding into the circular surface of the via hole 121. A center of the nut stud 14 has an electric wire receiving hole 141. An outer threaded surface of the nut stud 14 is exactly locked into the inner threaded hole 123 of the locking sleeve 12. A gap S is formed at the outer surface of the receptacle 13 along the radial direction so as to prevent the receptacle 13 from rotation as locking the nut stud 14. After the nut stud 14 is locked to the locking sleeve 12, an embedded stud 15 is tightly locked into the confining hole 124 of the locking sleeve 12 so as to integrate the nut stud 14 and the locking sleeve 12 as an integral body to prevent the nut stud 14 from rotation.

The locking seat 2 is formed by a lamp tube 21 extended from a top of the wall lamp and a plug 22 in the lamp tube 21.

The lamp tube 21 has a plug 22 at a position coupling to the retaining seat 1. The plug 22 is connected with an electric wire 221 therein. A lamp tube 21 is engaged with a positioning nut 23. After the plug 22 is inserted into the receptacle 13 of the retaining seat 1. The plug 22 can be tightly screwed into the top screwed section 143 of the nut stud 14 for positioning the lamp tube 21 to the retaining seat 1.

The operation of the present invention will be described herein. Referring to FIG. 3, the locking seat 2 is inserted into the retaining seat 1 and the plug 22 at a bottom of the locking seat 2 exactly inserts into the receptacle 13 of the retaining seat 1 so that the retaining seat 1 is conducted to the locking seat 2. Then the positioning nut 23 is tightly locked so that the locking seat 2 is positioned above the retaining seat 1. When it is desired to take the locking seat 2 from the retaining seat 1, it is only necessary to screw the positioning nut 23. Then the locking seat 2 is pulled out from the retaining seat 1.

Thereby, when packaging, transferring or storage the lamp seat, the locking seat 2 and the lamp rod 24 are pulled out from the retaining seat 1 in advance for reducing the volume for storage and transferring. Since the retaining seat 1 is assembled in a wire connection box D in advance, in assembly, it is only needed to insert the locking seat 2 into the retaining seat 1 for use rather than using any stud or locking device. Thereby, the assembly of the present invention is convenient and easily.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An easily assembled and detached wall lamp mounting device comprising a retaining seat, and a locking seat mounted on the retaining seat at one end; and another end of the locking seat being suspended with a wall lamp; characterized in that:

the retaining seat is formed by a supporting tube firmly secured to a wall and a surface of which has at least one through hole, a locking sleeve welded within the through hole of the supporting tube; a receptacle installed within the locking sleeve and having an electric wire therewithin, and a nut stud locked to the locking sleeve and exactly pressing against an upper side of the receptacle;

an inner side of the locking sleeve is installed with a stepped via hole; a receptacle is inserted into the via hole and exactly resists against the stepped edge; a circular surface of the via hole is formed with an inner threaded hole for locking the nut stud; a center of the nut stud has an electric wire receiving hole; an outer threaded surface of the nut stud is exactly locked into the inner threaded hole of the locking sleeve; the nut stud and the locking sleeve are integrated as an integral body to prevent the nut stud 14 from rotation;

the locking seat is formed by a lamp tube extended from a top of the wall lamp and a plug in the lamp tube;

the lamp tube has a plug at a position coupled to the retaining seat; the plug is connected with an electric wire therein; the lamp tube is engaged with a positioning nut; after the plug is inserted into the receptacle of the retaining seat; the plug is tightly screwed into the top screwed section of the nut stud for positioning the lamp tube to the retaining seat;

whereby, in packaging, transferring or storage the lamp seat, the locking seat and the lamp rod are pulled out from the retaining seat in advance for reducing the volume for storage and transfer.

2. The easily assembled and detached wall lamp mounting device as claimed in claim 1, wherein a confining hole is formed by protruding into a circular surface of the via hole; after the nut stud is locked to the locking sleeve, an embedded stud is tightly locked into the confining hole of the locking sleeve so as to integrate the nut stud and the locking sleeve as an integral body.

3. The easily assembled and detached wall lamp mounting device as claimed in claim 1, wherein the supporting tube of the retaining seat is formed with at least one via hole for installing a plurality of wall lamp.

4. The easily assembled and detached wall lamp mounting device as claimed in claim 1, wherein a gap is formed at an outer surface of the receptacle along the radial direction so as to prevent the receptacle from rotation as locking the nut stud.

* * * * *